US008740362B2

(12) United States Patent
Inoue et al.

(10) Patent No.: US 8,740,362 B2
(45) Date of Patent: Jun. 3, 2014

(54) INK TANK

(71) Applicant: Canon Kabushiki Kaisha, Tokyo (JP)

(72) Inventors: Ryoji Inoue, Kawasaki (JP); Haruo Uchida, Yokohama (JP); Yasuo Kotaki, Yokohama (JP); Tetsuya Ohashi, Matsudo (JP); Hiroki Hayashi, Kawasaki (JP); Masashi Ogawa, Kawasaki (JP); Takashi Fukushima, Yokohama (JP); Hironori Murakami, Tokyo (JP); Koki Yaegashi, Fukushima (JP); Norihiro Ikebe, Kawasaki (JP); Takayuki Aizawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/754,590

(22) Filed: Jan. 30, 2013

(65) Prior Publication Data

US 2013/0201261 A1 Aug. 8, 2013

(30) Foreign Application Priority Data

Feb. 3, 2012 (JP) ..... 2012-022294

(51) Int. Cl.
*B41J 2/175* (2006.01)

(52) U.S. Cl.
USPC ..... 347/86

(58) Field of Classification Search
USPC ..... 347/19, 86
See application file for complete search history.

(56) References Cited

U.S. PATENT DOCUMENTS 7,926,927 B2 * 4/2011 Kotaki et al. ..... 347/86
8,382,265 B2 * 2/2013 Matsumoto et al. ..... 347/86

FOREIGN PATENT DOCUMENTS

JP 2006-142796 A 6/2006

* cited by examiner

*Primary Examiner* — Anh T. N. Vo
(74) *Attorney, Agent, or Firm* — Canon USA Inc IP Division

(57) ABSTRACT

An ink tank includes a light-emitting portion and a light-guiding portion for guiding light emitted from the light-emitting portion, wherein the light-guiding portion includes an output portion configured to output the guided light to project individual information about the ink tank and a display portion formed on a side surface different from the output portion and configured to display information about a status of the ink tank by outputting the guided light.

8 Claims, 11 Drawing Sheets

INK TANK

BACKGROUND OF THE INVENTION

1. Field of the Invention

The present disclosure relates to an ink tank.

2. Description of the Related Art

In recent years, in response to demands for an ink jet recording apparatus having high image quality of a recording image, low-density ink such as light magenta and light cyan has been widely used in addition to conventional four colors (black, yellow, magenta, and cyan) ink. Further, using special ink such as red and blue ink has been also proposed.

In such a case, seven to eight ink tanks are individually mounted in the ink jet recording apparatus, and thus the ink tanks may be mounted in erroneous mounting positions. To prevent the ink tank from being mounted in the erroneous mounting positions as described above, for example, a method is known in which a main body side of a recording apparatus performs position authentication on each ink tank to notify a user of the erroneous mounting as described below.

Based on a signal input via a connection point (a pad) of the ink tank connected to an electrical connection point (a connector) at the main body side of the recording apparatus and individual information retained by the ink tank itself, light is emitted only at the ink tank that includes the individual information corresponding to the output signal. In the recording apparatus capable of performing such emission control for specifying the ink tank, the light is sequentially emitted at a plurality of ink tanks mounted on a carriage at a predetermined position along with a movement of the carriage.

The light emitted at predetermined timing at the predetermined position is detected to perform the position authentication. When the light emission is not detected, it is recognized that the ink tank whose light emission has not been detected is mounted at the erroneous position, which is notified the user of. Further, in addition to the information about the mounting position of the ink tank, it is desirable that information about a remaining amount of the ink in the ink tank be recognized by the user.

Conventionally, the information about the status of the ink tank as described above is transferred to a personal computer (PC) connected to the inkjet recording apparatus, and then the information is displayed on a monitor of the PC to notify the user. However, in recent years, along with the spread of digital cameras, a usage has been increasing in which a digital camera and the ink jet recording apparatus as the recording apparatus are directly connected to each other without via the PC to perform printing (non PC recording).

When the non PC recording is performed, a display may be provided on a main body of the ink jet recording apparatus to display the information. However, providing the display may increase the inkjet recording apparatus in cost and size, and further may impact design of the ink jet recording apparatus. Thus, it is not always desirable to provide the display.

A method is known in which the light is emitted at the ink tank itself to notify the user, as light information, of the information about the ink tank. That is, the method is to guide the light, on which the emission control is performed, to a position where the user can visually recognize the light with ease via a light-guiding member mounted on the ink tank, and then to display the light as the light information.

Japanese Patent Application Laid-Open No. 2006-142796 discusses the ink tank that has a function of preventing erroneous mounting by performing the position authentication on the ink tank as described above, and that notifies the user, as the light information, of information about the ink tank such as the mounting position and the amount of the remaining ink via the light-guiding member.

Processing for diffusing the light is performed on the display portion formed of a part of the light-guiding member and emitting the light information for notifying the user such that the user can visually recognize the light by viewing it at any angle. For this purpose, it is desirable that the light output from the display portion spreads with low directional characteristics.

On the other hand, as described above, the light-emitting portion of each of the plurality of ink tanks mounted on the carriage sequentially emits the light, and the light having the individual information about the ink tank and emitted from the predetermined position is detected to perform the position authentication of each ink tank. Thus, it is desirable that, when the ink tank is mounted at the erroneous position, the light including the individual information of the ink tank and used for the position authentication desirably has high directional characteristics so that the light emitted at the position is not detected by a light-receiving portion.

If the light has low directional characteristics and is diffused, when the light emitted from the ink tank, which is mounted at the erroneous position is received by the light-receiving portion, erroneous mounting may not be detected. As described above, the light output from the display portion for notifying the user of the information and the light output to perform the position authentication contradict each other in a more desirable output form.

Japanese Patent Application Laid-Open No. 2006-142796 discusses the technique in which the recording apparatus performs the position authentication by receiving the diffused light output from the display portion of the ink tank for notifying the user of the information about the status of the ink tank as the light including the individual information about the ink tank at the light-receiving portion of the main body side. Therefore, there arises an issue in which the light-receiving portion also receives the light of the ink tank mounted at the erroneous position, and the error cannot be recognized.

As described above, the ink tank having both forms as the display portion for notifying the user and an output portion for outputting the light used for the position authentication needs to select either one of the forms desirable as the output form. Simultaneously satisfying both demands contradicting each other is difficult.

SUMMARY OF THE INVENTION

According to an aspect of the present disclosure, an ink tank includes a light-emitting portion, and a light-guiding portion for guiding light emitted from the light-emitting portion, wherein the light-guiding portion includes an output portion configured to output the guided light to project individual information about the ink tank and a display portion formed on a side surface different from the output portion and configured to display information about a status of the ink tank by outputting the guided light.

Further features and aspects of the present disclosure will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the disclosure and, together with the description, serve to explain the principles disclosed herein.

DESCRIPTION OF THE EMBODIMENTS

Various exemplary embodiments, features, and aspects of the disclosure will be described in detail below with reference to the drawings.

Figure 1A:
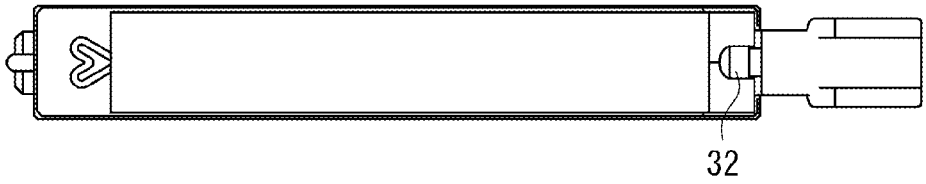
FIGS. 1A, 1B, 1C and 1D illustrate external appearances of an ink tank according to an exemplary embodiment.
Figure 1B:
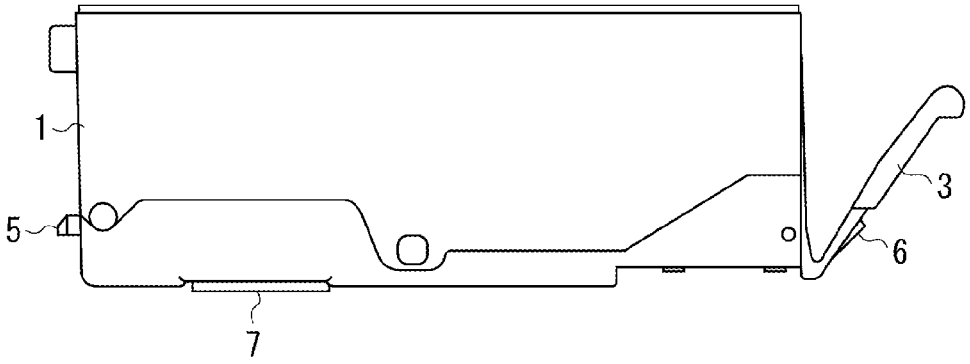
Figure 1C:
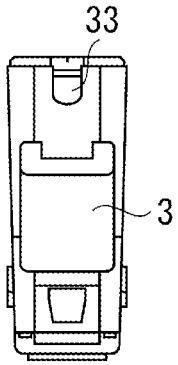
Figure 1D:
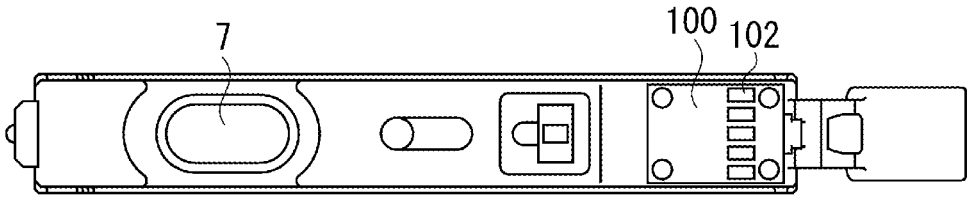

FIGS. 1A, 1B, 1C, and 1D illustrate examples of an external appearance of an ink tank according to an exemplary embodiment as disclosed herein. FIG. 1A is a top view of the ink tank, FIG. 1B is a side view thereof, FIG. 1C is a front view thereof, and FIG. 1D is a bottom view thereof. In the specification of the present disclosure, regarding an ink jet recording apparatus 200 (hereinafter, referred to as a "printer 200") illustrated in FIG. 7, a side close to a user 300 is defined as a "front" side and a side close to a sheet feeding unit 202 is defined as a "back" side.

In other words, regarding four side surfaces included in the ink tanks (1K, 1C, 1M, 1Y) mounted on the printer 200, a side surface facing the user 300 is defined as the side surface of the "front surface" side, and a side surface facing the sheet feeding unit 202 is defined as the side surface of a "back surface" side. Further, "upper" and "lower" respectively refer to an upper direction and a lower direction along the vertical direction when the ink tank is mounted on the printer 200.

As illustrated in FIGS. 1A, 1B, 1C, and 1D, an ink tank 1 according to the present exemplary embodiment includes a supporting member 3 supported at a lower portion of the side surface of the front side. The supporting member 3 is integrally formed of a same material as that of an exterior of the ink tank 1, and bent and elastically transformed when being mounted on a tank holder 150 described below, and then it can be engaged with a latching portion 155 of the tank holder 150.

The side surface of the back side of the ink tank 1 and the supporting member are respectively provided with a first engagement portion 5 and a second engagement portion 6 that can be engaged with each of the latching portions 155 and 156 of the tank holder 150. The first engagement portion 5 and the second engagement portion 6 engage with the respective latching portions 155 and 156 of the tank holder 150 to mount the ink tank 1 onto the tank holder 150. At a bottom surface of the ink tank 1, an ink supply opening 7 is provided that is combined with an ink guiding opening of a recording head described below, when the ink tank 1 is mounted on the tank holder 150, to supply the ink.

Figure 2:
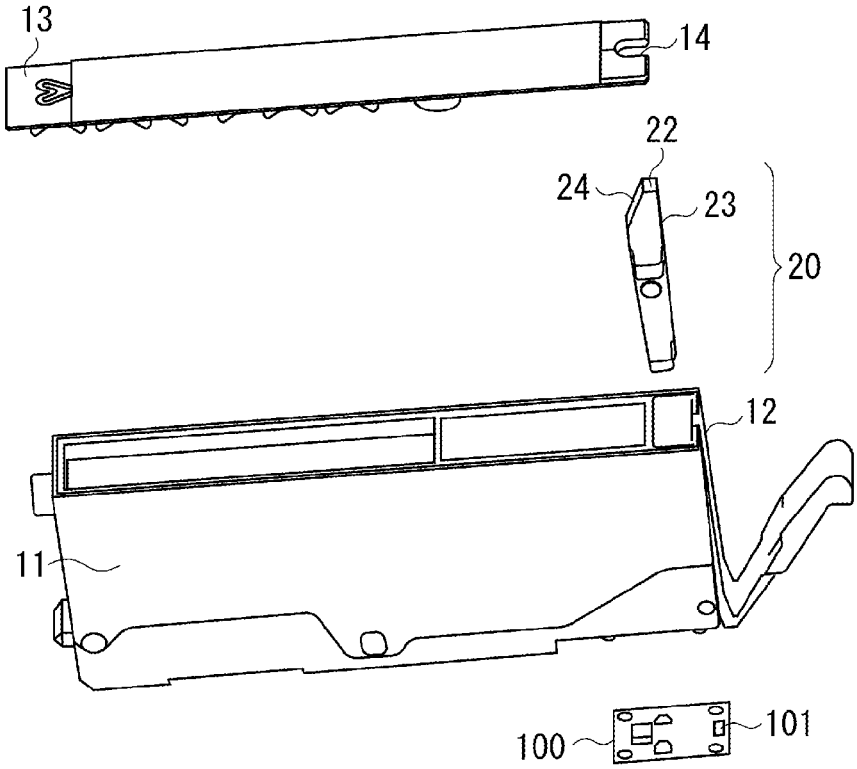
FIG. 2 is an exploded perspective view of the ink tank according to the exemplary embodiment.

FIG. 2 is an exploded, perspective view of the ink tank 1 according to the present exemplary embodiment, and illustrates individual members included in the ink tank 1. To the ink tank 1, a light-guiding member 20 is fixed by pressing to be inserted into a housing 11 at the front side with its top surface opened. By ultrasonic wave welding, a lid member 13 is fixed on the housing 11. A substrate 100 including a light-emitting portion 101 such as light emitting diode (LED) described below is provided on the bottom surface of the ink tank 1.

The light-guiding member 20 is a translucent member for guiding the light emitted from the light-emitting portion 101. The light-guiding member 20 includes an output surface 22 for outputting the light guided by the light-guiding member 20 to the light-receiving portion in the printer 200, a reflection surface 24 formed inclining toward the output surface 22 for reflecting the guided light, and a display surface 23 for outputting the light reflected at the reflection surface 24 to display the information.

Figure 3A:
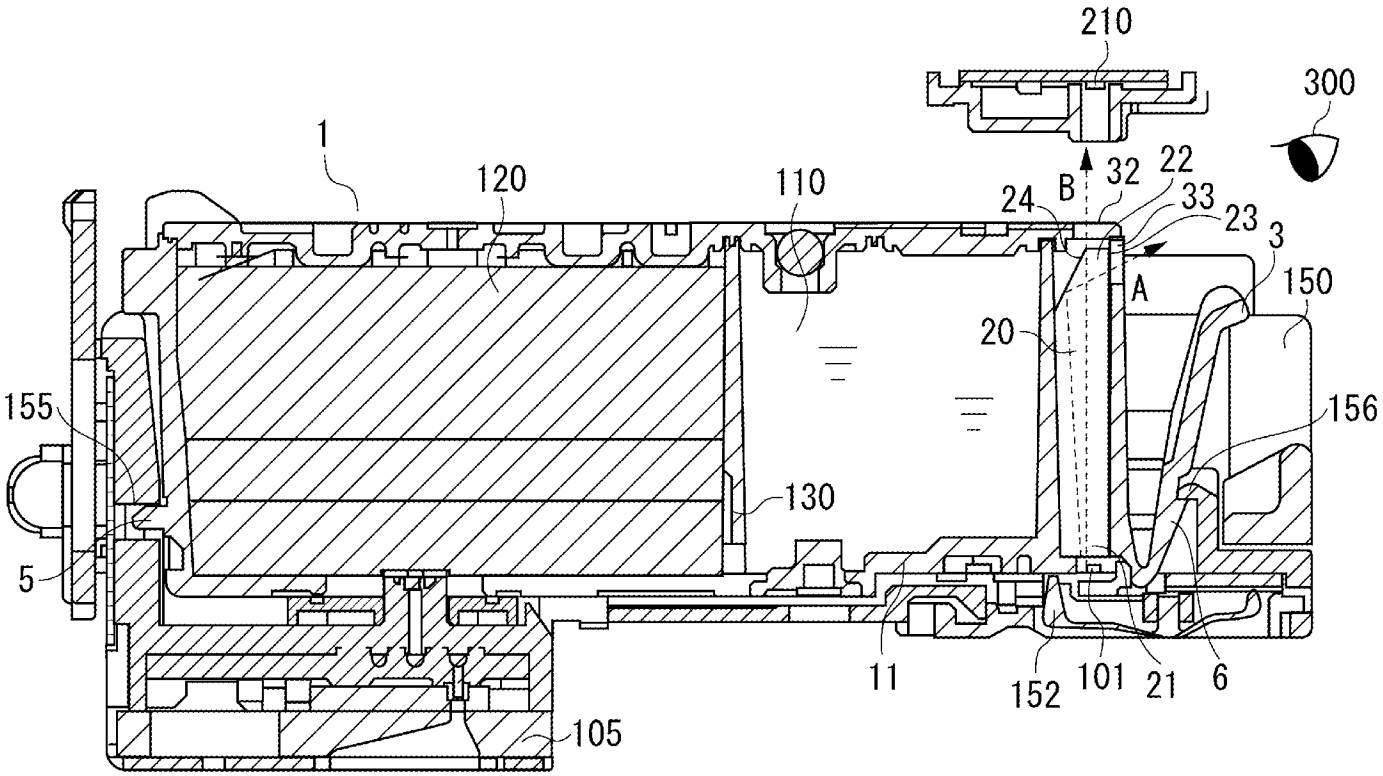
FIGS. 3A and 3B are cross sectional views illustrating the ink tank mounted on a tank holder according to the exemplary embodiment.

The light-guiding member 20 includes the reflection surface 24. Thus, as illustrated in FIG. 3A, to concentrate the light, the emitted light can be divided to a side surface (the output surface 22) formed on a light path (the arrow "B" of dotted line) where the emitted light advances straight and to a side surface (the display face 23) different from the output face 22, so that a sufficient amount of light can be output via the display surface 23.

The lid member 13 includes a cutout portion 14 at the front side thereof. An output portion 32 as illustrated in FIG. 1A is formed of the cutout portion 14 and the output surface 22 of the light-guiding member 20, to output the light from the light-emitting portion to a light-receiving portion 210 at the main body side. Further, the housing 11 also includes a cutout portion 12 at the front side thereof. A display portion 33 as illustrated in FIG. 1C is formed of the cutout portion 12 and the display surface 23 of the light-guiding member 20 described below, to output the light from the light-emitting portion 101 to the user.

The light output from the output portion 32 and received by the light-receiving portion 210 at the main body side includes the individual information about the ink tank and is used for the position authentication, and the light is also the identification information about the ink tank including color information about the stored ink. As described above, according to the specification of the present invention, the "output portion 32 for projecting the individual information about the ink tank" refers to the portion for outputting the light to perform the position authentication for a mounting position of the ink tank 1.

Further, the "display portion 33 for displaying the information about the status of the ink tank 1" refers to the portion for outputting the light for informing the user of the information about the status of the ink tank 1 such as the amount of the remaining ink.

A light-guiding portion according to the present exemplary embodiment divides the light into the light including the individual information about the ink tank 1 and used for the position authentication, and the light for notifying the user of the information about the ink tank such as the amount of the remaining ink, and then outputs the light. With this arrangement, the light can be output in each desirable output form. More specifically, the light is diffused and output via the display portion 33 so the user can visually recognize the light more easily. On the other hand, the light is concentrated to be output via the output portion 32 so that the light can have the higher directional characteristics at the light-receiving portion 210 at the main body side of the ink jet recording apparatus 200.

Accordingly, the desirable output forms of both the display portion 33 and the output portion 32 that contradict each other can be realized to perform the highly reliable position authentication for preventing the erroneous mounting and the information notification that can be visually recognized with ease by the user.

The light-guiding portion according to the present exemplary embodiment is formed by inserting the light-guiding member 20 into a space formed in the housing 11. However, the light-guiding portion of the present invention is not limited thereto. For example, by using the "space" into which the light-guiding member 20 is inserted as the light-guiding portion, the light from the light-emitting portion 101 may be output from the cutout portion 14 formed at the lid member 13, while the light may be output from the cutout portion 12 formed at the side surface of the front side of the housing 11, so that the light is divided and output.

Figure 3B:
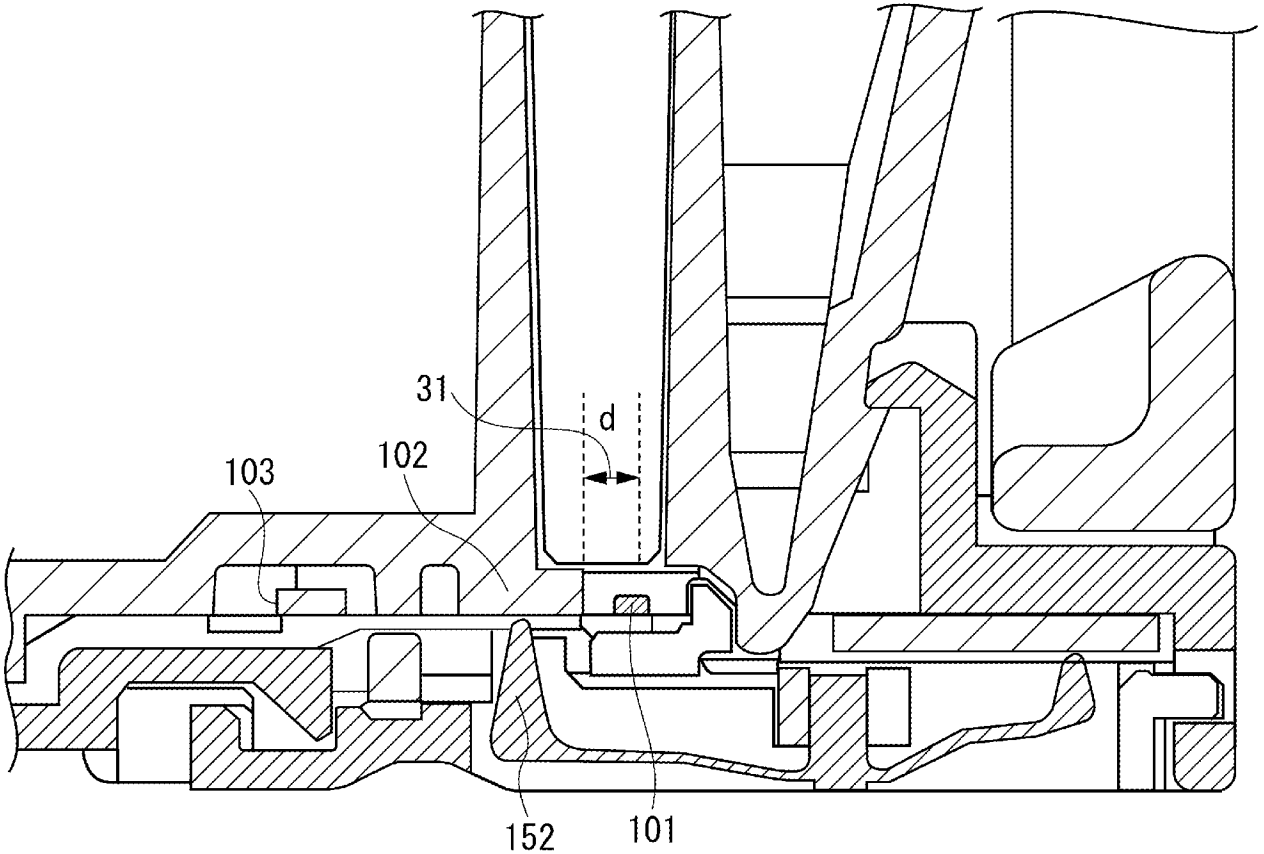

FIGS. 3A and 3B are cross sectional views illustrating states of the ink tank 1 mounted on the tank holder 150 according to the present exemplary embodiment. As illustrated in FIG. 3A, the first engagement portion 5 at the back side of the ink tank 1 is engaged with the latching portion 155 of the tank holder 150, and the second engagement portion 6 of the front side of the ink tank 1 is engaged with the latching portion 156 of the tank holder 150, to fix the mounted ink tank 1 to the tank holder 150.

As described above, the substrate 100 provided with the light-emitting portion 101 such as the LED used as a light-emitting unit of the ink tank 1 mounted on the tank holder 150 is positioned below the light-guiding member 20. A first light path "A" indicated with the arrow "A" of the dotted line illustrates a state where a part of the light emitted from the light-emitting portion 101 enters inside the light-guiding member 20, and is reflected on the reflection surface 24 to be output via the display surface 23, and then output to the outside via the display portion 33.

Further, a second light path "B" indicated with the arrow "B" of the dotted line illustrates a state where a part of the light emitted from the light-emitting portion 101 enters inside the light-guiding member 20, advances straight to be output via the output surface 22, and then is output to the outside via the output portion 32. The user 300 visually recognizes the light passing through the first light path "A" and output via the display portion 33, and then recognizes the information. The light-receiving portion 210 fixed to the main body side receives the light passing through the second light path "B" and output via the output portion 32 to perform the position authentication.

Furthermore, the output surface 22 for outputting the light including the individual information about the ink tank 1 and used for the position authentication, and the display surface 23 for outputting the light to be visually recognized by the user may be disposed at reversed positions to each other. In other words, the position authentication may be performed with the light output from the front side and the user may visually recognize the light that is output upward.

The "information about the ink tank 1" according to the specification of the present invention can include the information about whether the ink tank 1 is appropriately mounted (in other words, whether mounting is perfectly performed), whether the ink tank 1 is mounted at the right position (whether the ink tank 1 is correctly mounted at the mounting position on the tank holder 150 that is previously determined corresponding to the ink color), and further whether the ink remains (whether the sufficient amount of the ink remains). That can be performed according to whether the light is emitted from the light-emitting portion or a state of emitting the light (blinking).

Since the light output via the display surface 23 needs to be visually recognizable at angles in a wide range, it is desirable to make the surface of the display surface 23 rough to diffuse the light by the rough surface to increase an output region of the light.

Particularly, when a material having excellent light-permeability such as polystyrene and polycarbonate is used for the light-guiding member 20, all the light reflects on the display surface 23 as an output surface, except for the light as indicated with the arrow "A" of the dotted line advancing substantially vertically with respect to the display surface 23. Thus, the light cannot be visually recognized at angles except for a certain angle. Therefore, when such a material is used, particularly, it is effective that the light output via the light emitting surface is diffused on the display surface 23 to be emitted at the angle in the wide range.

Specific methods for making the surface rough include pear-skin processing and surface texturing processing. Particularly, the surface texturing processing is desirable because the surface texturing processing can engrave a fine irregular pattern on the surface to diffuse the light radially and uniformly.

A dimension and a form of the display surface 23 can be appropriately adjusted to ensure sufficient diffusion of an output region of the light. For example, in FIG. 3A, the display surface 23 can be adjusted to form a curved surface of the convex portion toward the user 300. When the light is output from the inside of the light-guiding member 20 to an atmosphere layer via such a curved surface as a surface boundary, the light is output at an increased output angle and thus the light is diffused.

A dimension and a form of the cutout portion 12 provided at the front side of the housing 11 disposed at the side surface of the ink tank 1, and forming the display portion 33 may be adjusted to increase the output region of the light. As described above, the processing and adjustment for increasing the output region can be appropriately performed.

As illustrated in FIGS. 3A and 3B, an incident portion 31 and the output portion 32 for the light-guiding member 20 according to the present exemplary embodiment are substantially disposed along the vertical direction with respect to the substrate 100. Further, the light-guiding member 20 includes an incident surface 21 that is substantially parallel to the substrate 100 provided with the light-emitting portion 101 at a lower end portion of the light-guiding member 20, and the output surface 22 that is substantially parallel to the incident surface 21 at an upper end portion thereof.

As described above, three surfaces including a surface provided with the light-emitting portion 101, the incident surface 21, and the output surface 22 are disposed along the substantially vertical direction from the light-emitting portion 101, and are formed substantially parallel to one another. That remarkably increases an efficiency of using the light from the light-emitting portion 101. A reason for the increased efficiency is that, among the light radially emitted from the light-emitting portion such as the LED, generally, the largest amount of the vertical light advances in the substantially vertical direction with respect to a surface on which the light-emitting portion is provided.

Another reason is that a part of the light, except for the light advancing in the substantially vertical direction, is reflected without being transmitted when passing through the surface boundary between different mediums, thereby reducing the light amount. That is, for the ink tank 1 according to the present exemplary embodiment, the surface provided with the light-emitting portion 101, the incident surface 21 of the light-guiding member 20, and the output surface 22 thereof are set uniformly, horizontally. Accordingly, the efficiency of using the light is increased as described above, so that even the LED having a small amount of the light and the light-emitting portion to which a large driving power cannot be applied can be used as a light-emitting unit.

As illustrated in FIG. 3B, in the light-guiding member 20, the incident surface 21 is covered with a part of the housing 11 supporting the incident surface 21, to block a part of the light emitted from the light-emitting portion 101, so that the incident portion 31 is formed where the light can enter in the width "d" indicated with the arrow. Further, in the ink tank 1 according to the present exemplary embodiment, an output area included in the output portion 32 is set smaller than an incident area included in the incident portion 31.

By setting the output area of the output portion 32 smaller as described above, the light entering the light-guiding member 20 is concentrated at the output portion 32 to output the light having higher density. Accordingly, the amount of the light output via the output portion 32 can be secured and also the directional characteristics can be improved to increase difference in the light amount between the correct mounting position and the erroneous mounting position, thereby improving accuracy of the detection of the erroneous mounting.

The incident portion 31 can be disposed near the light-emitting portion 101. This is because, since the amount of the light entering the light-guiding member 20 is in reverse proportion to the square of the distance between the light-emitting portion 101 and the incident portion 31, if the incident portion 31 is disposed near the light-emitting portion 101, the light emitted from the light-emitting portion 101 enters the light-guiding member 20 without leaking, thereby improving the efficiency of using the light.

As illustrated in FIG. 3A, an inside of the ink tank 1 is divided into an ink storage chamber 110 positioned at the front side and storing the ink, and a negative pressure generating member storage chamber 120 positioned at the back side and connecting to the ink supply opening 7. The ink storage chamber 110 and the negative pressure generating member storage chamber 120 are connected with each other through the communication portion 130.

The ink storage chamber 110 stores the ink as it is. On the other hand, the negative pressure generating member storage chamber 120 is provided with an ink absorbing member (hereinafter, referred to as a "porous member" for convenience) such as sponge and fiber lump that impregnate and retain the ink. Such porous members sufficiently decrease leakage of the ink from an ink discharge portion in balance with a retaining force of meniscus formed at a nozzle portion of a recording head for discharging ink, so that the porous members generate an appropriate negative pressure within a range where the recording head can perform the ink discharge operation.

A first ink absorbing member (an ink absorbing member at a top portion), a second ink absorbing member (an ink absorbing member in the middle), and a third ink absorbing member (an ink absorbing member at a bottom portion), which are all made of ink absorbing members as described above, are pressed to form the negative pressure generating member storage chamber 120. Strength of a capillary force of the ink absorbing members described above is as follows. (strength P1 of the capillary force of the ink absorbing member at a top portion)<(strength P2 of the capillary force of the ink absorbing member in the middle)<(strength P3 of the capillary force of the ink absorbing member at a bottom portion).

An absorbing member surface boundary between the third ink absorbing member (the ink absorbing member at the bottom portion) and the second ink absorbing member (the ink absorbing member in middle) is formed at a position of height where the communication portion 130 is divided.

Since the ink absorbing members stored in the negative pressure generating member storage chamber 120 are constructed in such a manner as described above, an air flow passage and a liquid flow passage for exchanging gas and liquid via the communication portion 130 can be securely ensured, and further, a liquid surface of the ink retained in the ink absorbing member can be favorably recovered.

An internal configuration of the ink tank 1 is not limited to the form of the storage chambers divided into the storage chamber made of the porous members and the storage chamber for storing the ink as it is. For example, the porous member may substantially fill all over the space inside the ink tank 1.

Further, instead of using the porous member as the negative pressure generating unit, a bag-shaped member formed of an elastic material such as rubber generating a tensional force in a direction for expanding volume may be filled with the ink as it is, and the bag-shaped member may apply the negative pressure to the internal ink with the generated tensional force. Further, at least a part of the space for storing the ink may be configured by a flexible member to store the ink only in the space, and a spring force may be applied to the flexible member to generate the negative pressure.

At a bottom portion of the ink storage chamber 110, a detected portion (not illustrated) is provided at a position that faces an ink remaining amount detection sensor provided at the apparatus side when the ink tank 1 is mounted to the apparatus. According to the present exemplary embodiment, the ink remaining amount detection sensor is an optical sensor including a light-emitting element and a light-receiving element. The detected portion is made of a transparent or translucent material and has a prism-like shape with an inclined portion having a predetermined form and angle so that the light from the light-emitting element is appropriately reflected to return to the light-receiving element when the ink is not stored.

On a top surface of the negative pressure generating member storage chamber 120, an atmosphere communication portion (not illustrated) for guiding atmosphere inside to reduce the negative pressure increasing along with ink supply to the recording head and to maintain the negative pressure within a desirably predetermined range.

Figure 4A:
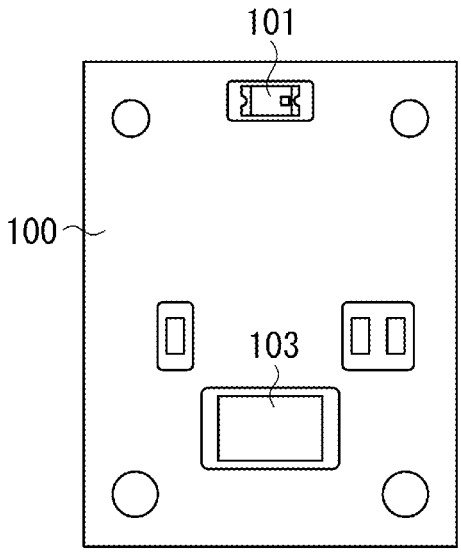
FIGS. 4A and 4B illustrate states of an inside surface and an outside surface of a substrate of the ink tank according to the exemplary embodiment.
Figure 4B:
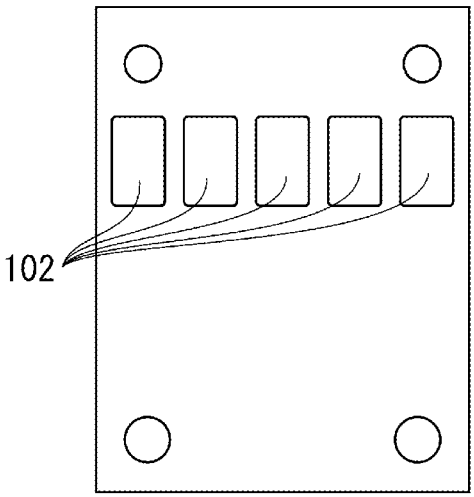

FIGS. 4A and 4B illustrate states of an inside surface and an outside surface of the substrate 100. FIG. 4A illustrates the state of the inside surface of the substrate 100 that is not exposed outside when the substrate 100 is mounted on the ink tank 1. The substrate 100 is provided with the light-emitting portion 101 emitting the light including visible light such as an LED and a control element 103 for controlling the light-emitting portion 101. FIG. 4B illustrates the state of the outside surface of the substrate 100 that is exposed outside when the substrate 100 is mounted on the ink tank 1. The substrate 100 is provided with s a plurality of electrode pads 102 for contacting electrical connection points at the main body side.

The control element 103 controlling the light-emitting portion 101 controls light-emission of the light-emitting portion 101 by an electric signal supplied from the main body side via the electrode pat 102. As illustrated in FIG. 3B, in a state where the ink tank 1 is fixed to the tank holder 150, the electric connection between the ink tank 1 and the main body side can be realized when an electric connection point 152 provided on the tank holder 150 and the electrode pat 102 provided on the outside surface of the substrate 100 provided in the ink tank 1 contact each other.

Figure 5A:
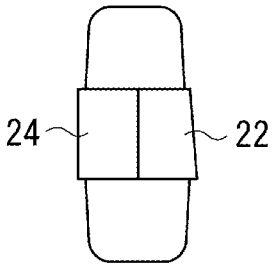
FIGS. 5A, 5B, 5C, and 5D illustrate external appearances of a light-guiding member according to the exemplary embodiment.
Figure 5B:
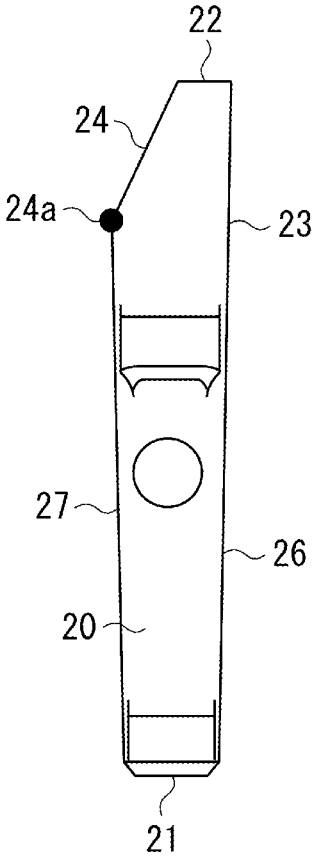
Figure 5C:
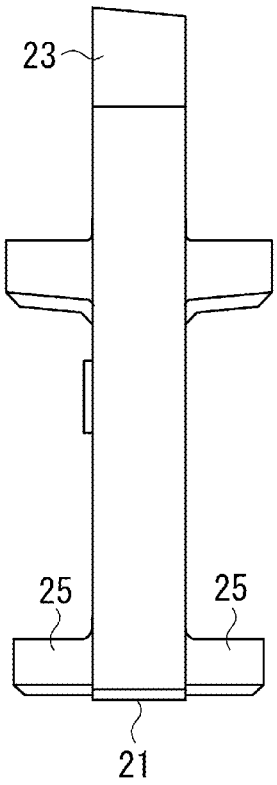
Figure 5D:
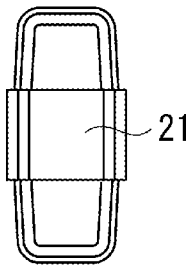

FIGS. 5A, 5B, 5C, and 5D illustrate external appearances of the light-guiding member 20 according to the present exemplary embodiment. FIG. 5A is a top view of the light-guiding member 20, FIG. 5B is a side view thereof, FIG. 5C is a front view thereof, and FIG. 5D is a bottom view thereof.

As illustrated in FIG. 5B, the light-guiding member 20 includes the output surface 22 formed on the top surface, the display surface 23 formed on the side surface of the front side, and the reflection surface 24 inclining toward the output surface 22 and formed on the side face facing the display surface 23. As described above, a surface adjacent to the output surface 22 is inclined to form the reflection surface 24. Thus, as illustrated in FIG. 3A, the light path on the light path "A" until the light is reflected on the reflection surface 24 to be bended is arranged in the substantially vertical direction, which is slightly inclined from the substantially vertical direction with respect to the substrate 100 provided with the light-emitting portion 101.

With this arrangement, by using a nature in which the largest amount of the light advances in the vertical direction as described above, the light in the light path "A" for notifying the user 300 of the information that is separated from the light path "B" used for the position authentication can be also used with high efficiency and greater amount.

As illustrated in FIG. 5B, from the incident surface 21 to the reflection surface 24, the light-guiding member 20 includes inclined surfaces 26 and 27 that are inclined such that a cross sectional area in a horizontal direction is gradually increased from the incident surface 21 to an end portion 24*a* of the reflection surface 24. Effects acquired by including such inclined surfaces 26 and 27 will be described with reference to schematic views of the light-guiding member 20 illustrated in FIGS. 8A and 8B.

Figure 8A:
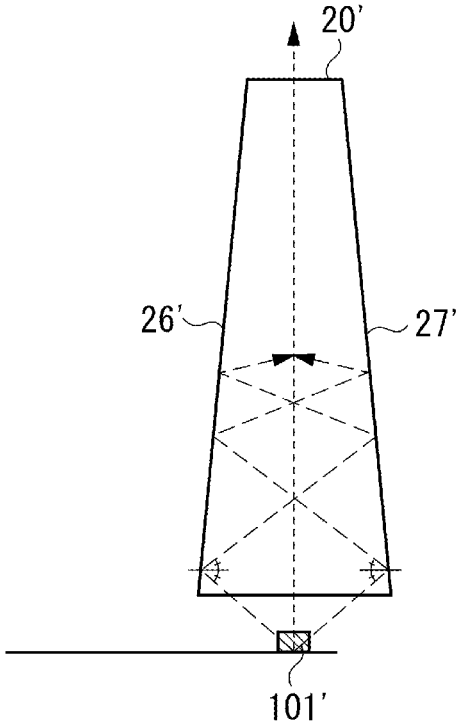
FIGS. 8A and 8B are schematic views of the light-guiding member illustrated in FIGS. 5A, 5B, 5C, and 5D.

FIG. 8A illustrates a case where side surfaces are inclined in a direction in which the cross sectional area of the light-guiding member 20' is decreased in the horizontal direction. Of the light emitted from a light-emitting portion 101', the light advancing in the substantially vertical direction with respect to the substrate 100 advances direct. On the other hand, the light advancing at an angle $\alpha$ in directions other than the substantially vertical direction indicated with an arrow of a dotted line advances upward by repeatedly reflecting on inclined surfaces 26' and 27' at angles gradually becoming close to the horizontal direction.

Figure 8B:
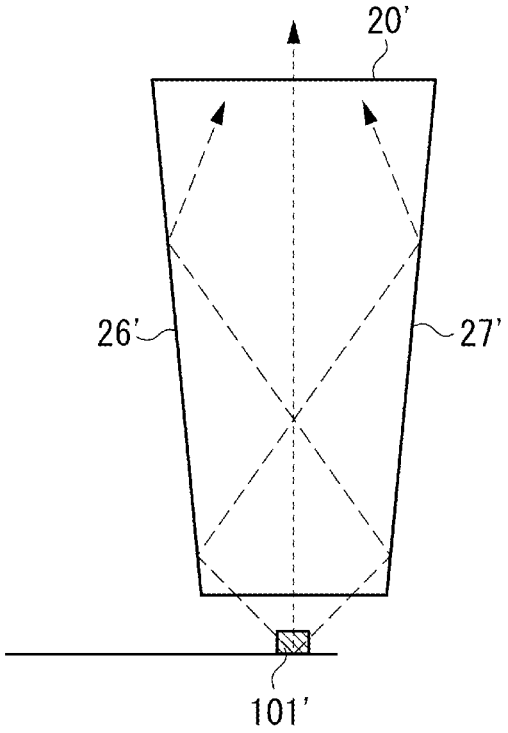

On the other hand, as illustrated in FIG. 8B, when the inclined surfaces are inclined in a direction in which the cross sectional area of the light-guiding member 20' is increased, the light advancing in direction other than the substantially vertical direction is reflected the least number of times on the inclined surfaces 26' and 27' at an angle corresponding to an almost substantially vertical direction to reach upward. Therefore, the inclined surfaces 26' and 27' are inclined in the direction in which the cross sectional area of the light-guiding member 20' is increased in the horizontal direction, so that the amount of the light of the light-emitting portion 101, which is reduced by the reflection on the side surfaces of the light-guiding member 20', can be sufficiently secured and that the light can be efficiently guided to the output portion.

Figure 6:
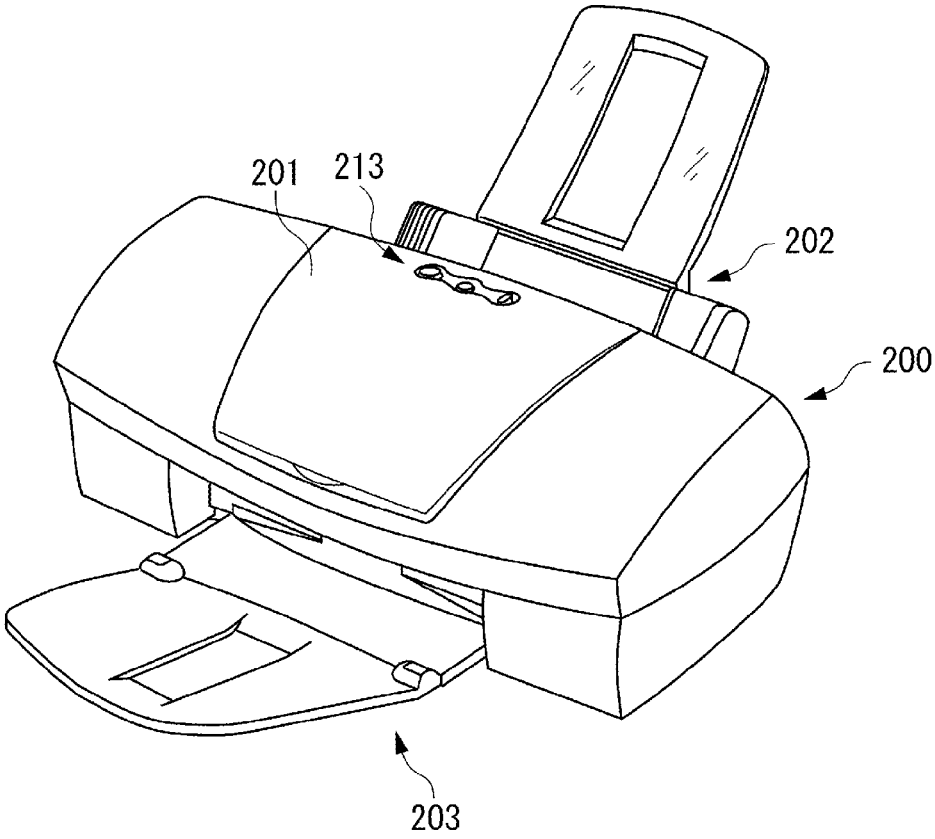
FIG. 6 is a perspective view illustrating an external appearance of an ink jet recording apparatus.
Figure 7:
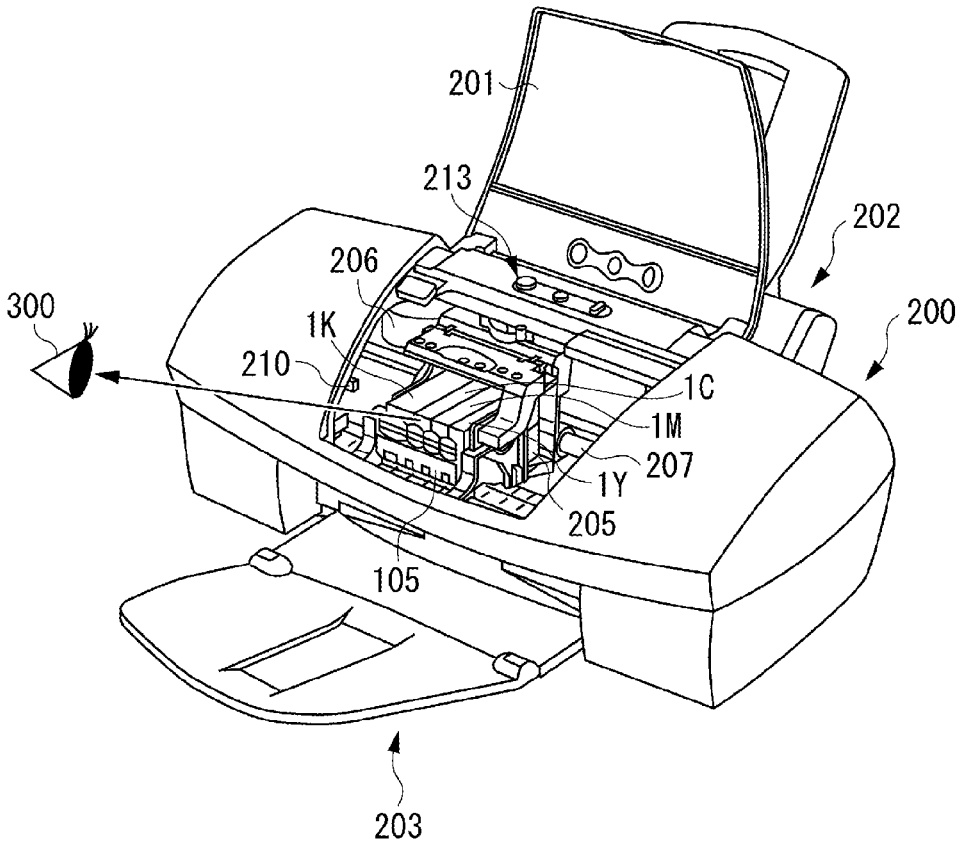
FIG. 7 is a perspective view illustrating the ink jet recording apparatus illustrated in FIG. 6 with its body cover opened.

FIG. 6 illustrates an external appearance of a printer 200, with the ink tank 1 mounted, performing recording according to the present exemplary embodiment. FIG. 7 is a perspective view illustrating a state of the printer 200 illustrated in FIG. 6 when a cover of its main body is opened.

The printer 200 according to the present exemplary embodiment includes a printer main body in which a mechanism, where a carriage mounting the recording head and the ink tank 1 performs scanning and recording, is covered with a main body cover 201 and other case portion, a sheet discharge tray 203 each provided at a front portion and at a back portion of the printer main body, and an automatic sheet feeder (ASF) 202.

Further, the printer 200 includes an operation unit 213 including a display device for displaying a status of the printer 200 both when the main body cover is closed and opened, a power switch, and a reset switch.

When the main body cover 201 is opened, as illustrated in FIG. 7, the user 300 can watch a range, and a periphery of the range, where a carriage 205 moves that mounts a recording head unit 105 and the ink tanks 1K, 1Y, 1M, 1C (hereinafter, the ink tanks 1K to 1C may be indicated with the same reference numeral "1").

Actually, when the main body cover 201 is opened, a sequence is performed in which the carriage 205 automatically moves to a substantially center position (hereinafter, referred to as a "tank replacement position") illustrated in FIG. 7, and the user 300 can perform a replacement operation of the ink tanks 1 at the tank replacement position.

In the printer 200 according to the present exemplary embodiment, the recording head (not illustrated) in a chip-like shape corresponding to each ink color is provided in the recording head unit 105. Such a recording head in each ink color performs scanning on a recording medium such as a sheet by movement of the carriage 205. The ink is discharged onto the recording medium during scanning to perform recording.

In other words, the carriage 205 is slidably engaged with a guiding shaft 207 extending in a movement direction of the carriage 205, and the above-described movement can be performed by a carriage motor and its transmission mechanism. Each recording head corresponding to the ink of K, Y, M, C discharges ink based on discharge data transmitted from a control circuit at the main body side via a flexible cable 206.

Further, a sheet feeding mechanism such as a sheet feeding roller and a sheet discharging roller is provided to convey to a sheet discharge tray 203 the recording medium (not illustrated) fed from a sheet feeding unit 202. The recording head unit 105 integrally provided with the ink tank holder 150 is detachably mounted in the carriage 205. Each ink tank 1 is detachably mounted in the recording head unit 105.

Regarding a recording operation, while the recording head performs scanning by the above-described movement, the ink is discharged onto the recording medium from each recording head to perform recording in a region having an effective width corresponding to a discharge opening arrangement range (direction orthogonal to a recording head main scanning direction) of the recording head. The above-described sheet feeding mechanism feeds a predetermined number of sheets having the above-described width or less between the scanning and the next scanning to sequentially perform recording onto the recording medium.

At an end portion of a movement range of the recording head along with the movement of the above-described carriage 205, a discharge recovery unit is disposed in each recording head such as a cap covering a surface on which a discharge opening is provided. With this arrangement, the recording head moves to a position at which the recovery unit is provided at a predetermined time interval to perform recovery processing such as preliminary discharge.

The recording head unit 105 including the tank holder 150 on which the plurality of ink tanks 1 is to be mounted is provided with the electrical connection point 152 corresponding to each ink tank 1 as described above. Each electrical connection point 152 contacts the electrode pat 102 to be electrically connected therewith on the substrate 100 provided on the ink tank 1 to be mounted.

With this arrangement, control for lighting on/off according to a predetermined sequence performed at the main body side can be performed on each light-emitting portion 101. With this arrangement, the information about the status of the ink tank 1 can be notified.

Further, according to the present exemplary embodiment, in the movement range of the carriage 205, the light-receiving portion 210 including the light-receiving element is disposed near the end portion at an opposite side of a position where the above-described recovery unit is disposed. At timing when each mounted ink tank 1 passes the light-receiving portion 210 along with the movement of the carriage 205, the light-emitting portion 101 sequentially emits the light to project the light including the individual information about the ink tank 1 via the output portion 32, and then the light is received by the light-receiving portion 210 at the main body side.

As described above, the light emitted from each ink tank 1 is detected whether the ink tank 1 is correctly mounted on the carriage 205 depending on whether the light is received at predetermined timing.

When it is detected that the ink tank 1 is erroneously mounted or the amount of the remaining ink is decreased, the information about such a status of the ink tank 1 is notified to the user 300 via the display portion 33 by lighting on or blinking the light-emitting portion 101 of the ink tank 1. In a similar manner to the control such as the ink discharge of the recording head, the control described above is performed by transmitting the control data (the control signal) to each ink tank 1 from the control circuit at the main body side via the flexible cable 206.

While the present invention has been described with reference to exemplary embodiments, it is to be understood that the invention is not limited to the disclosed exemplary embodiments. The scope of the following claims is to be accorded the broadest interpretation to encompass all modifications, equivalent structures, and functions.

This application claims priority from Japanese Patent Application No. 2012-022294 filed Feb. 3, 2012, which is hereby incorporated by reference herein in its entirety.

What is claimed is:

1. An ink tank comprising:

a light-emitting portion; and a light-guiding portion for guiding light emitted from the light-emitting portion, wherein the light-guiding portion includes two surface facing each other, an output surface formed at a top of the light-guiding portion and configured to output the guided light, and a reflecting surface slanted for the two surfaces and the output surface, wherein the two surfaces connected by the output surface and the reflecting surface, one of the two surfaces is a display surface configured to display information about a status of the ink tank by outputting the guided light, and the reflecting surface reflects the guided light for the display surface.

2. The ink tank according to claim 1, wherein the light-guiding portion is a translucent light-guiding member.

3. The ink tank according to claim 1, wherein the light-emitting portion is disposed on one surface that is substantially parallel to a bottom surface of the ink tank, and wherein the output surface is formed substantially parallel to the one surface to output the light upward from the ink tank.

4. The ink tank according to claim 3, wherein the light-guiding member further includes an incident surface through which the light emitted from the light-emitting portion located below the light-guiding member enters, and wherein the incident surface is opposed to the one surface.

5. The ink tank according to claim 1, wherein the output surface configured to output the guided light to a light-receiving member of an ink jet recording apparatus.

6. The ink tank according to claim 1, wherein the ink tank have a supporting member engageable with a latching portion of the ink tank, the display surface of the light-guiding portion being provided at a side facing the supporting member.

7. An ink tank mountable on an ink jet recording apparatus and configured to emit light, the ink tank comprising:

a light-emitting portion; and a light-guiding portion configured to guide light emitted from the light-emitting portion, wherein the light-guiding portion includes two surface facing each other, an output surface formed at a top of the light-guiding portion and configured to output the guided light, and a reflecting surface slanted for the two surfaces and the output surface to a light-receiving portion disposed at a main body side of the ink jet recording apparatus wherein the two surfaces connected by the output surface and the reflecting surface, one of the two surfaces is a display surface configured to display information about a status of the ink tank by outputting the guided light, and the reflecting surface reflects the guided light for the display surface.

8. The ink tank according to claim 7, wherein the light-guiding portion is a translucent light-guiding member.

* * * * *